United States Patent [19]

Thompson

[11] Patent Number: 5,010,704

[45] Date of Patent: Apr. 30, 1991

[54] GLASS BLOCK CONSTRUCTION ASSEMBLY

[76] Inventor: Earl G. Thompson, 16121 SE. Fourth St., Vancouver, Wash. 98684

[21] Appl. No.: 525,569

[22] Filed: May 21, 1990

[51] Int. Cl.[5] ..... E04G 21/18

[52] U.S. Cl. ..... 52/308

[58] Field of Search ..... 52/308, 306

[56] References Cited

U.S. PATENT DOCUMENTS 2,141,000 12/1938 Hohl ..... 52/308
2,239,537 4/1941 Owen ..... 52/308
3,234,699 2/1961 Smith .
3,252,260 5/1966 Mills .
4,635,420 1/1987 Batky .
4,774,793 10/1988 Mayer .

*Primary Examiner*—John E. Murtagh
*Attorney, Agent, or Firm*—Henderson & Sturm

[57] ABSTRACT

A glass block construction assembly (10) comprising an assembly unit (11) which contains an open matrix formed by horizontal (12) and vertical (13) alignment units for receiving a plurality of glass blocks (100) in a matrix wherein all of the structural components of the assembly (10) with the exception of the glass blocks (100) are fabricated from contoured apertured slat members (20) and generally thin, flat slat members (30).

3 Claims, 2 Drawing Sheets

GLASS BLOCK CONSTRUCTION ASSEMBLY

TECHNICAL FIELD

The present invention relates to the field of structural members in general, and in particular to a method and apparatus for joining glass blocks into a desired structural assembly which replaces the mortar conventionally used and this method and material can be employed both with or without adhesive.

BACKGROUND ART

As can be seen by reference to the following U.S. Pat. Nos. 3,234,699; 3,252,260; 4,635,420; and 4,774,793; the prior art is replete with myriad and diverse structural assembly techniques for glass blocks and/or panels.

While all of the aforementioned prior art constructions are more than adequate for the basic purpose and function for which they have been specifically designed, these prior art assemblies do not produce a stable, reinforced, support framework which will quickly and easily accommodate a plurality of glass blocks in a conventional structural configuration such as straight and curved walls and windows.

In addition, the prior art techniques which do not use mortar do not have provisions for accommodating glass blocks in either various uniform sizes or in mixed sizes to produce different aesthetic effects, using only one basic strip.

As a consequence of the foregoing situation, there has existed a longstanding need in the building trades for a method and apparatus that will facilitate the assembly and erection of structural elements whose main structural component comprises a glass block, and the provision of such an arrangement is a stated objective of the present invention.

In addition, windows on exterior walls and permanent installations would be constructed using adhesive (i.e. silicone or the like) while interior windows or dividing partition walls assembled without adhesive could be easily disabled and used, or moved elsewhere, whereby each component part would remain intact.

DISCLOSURE OF THE INVENTION

Briefly stated, the main structural components of the glass block construction assembly that forms the basis of the present invention comprise an outer assembly unit, vertical alignment units, horizontal alignment units and both horizontal and vertical brace units which form a matrix for captively surrounding glass block units in a desired configuration having predetermined dimensions.

As will be explained in greater detail further on in the specification, the outer assembly unit comprises an apertured generally rectangular framework member having spaced apertures whose spacing will coincide with conventional glass blocks having different dimensions.

In addition, the horizontal and vertical alignment units are dimensioned to be received in the apertured walls of the framework member and the horizontal alignment unit is also provided with spaced apertures that will accommodate the spacing of the vertical alignment units depending upon the size and/or sizes of the particular glass blocks that are to be employed in the finished construction.

Furthermore, the horizontal and vertical brace units are dimensioned and configured to provide structural reinforcement to the horizontal and vertical alignment units deployed throughout the support matrix which is confined within the outer assembly unit; wherein, the glass blocks are installed into assembly units such as prepared wall openings or supported free standing configurations.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
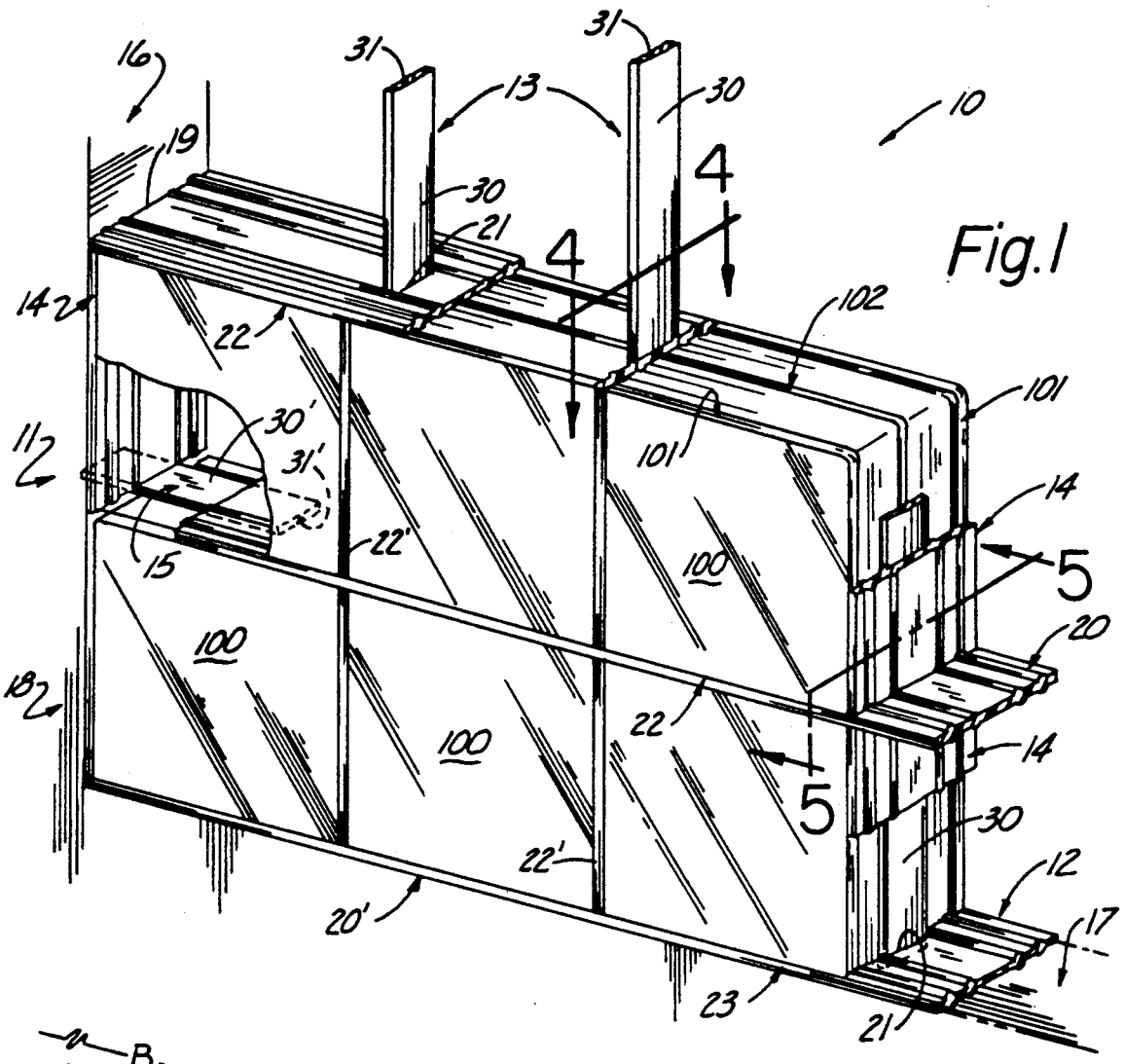
FIG. 1 is a perspective view of the structural components which comprise the assembly of the invention.

As can best be seen by reference to the drawings, and in particular to FIG. 1, the glass block construction assembly that forms the basis of the present invention is designated generally by the reference numeral (10). The assembly (10) comprises an outer assembly unit (11), vertical (12) and horizontal (13) alignment units and vertical (14) and horizontal (15) jamb tie units which form a matrix for receiving glass building blocks (100). These units will now be described in seriatim fashion.

Prior to embarking upon the detailed description of the structural components that comprise the assembly (10), it would first be advisable to discuss the configuration and construction of the glass building blocks (100). As can be seen by reference to FIG. 1, each outer edge of the glass building blocks (100) has a generally rectangular configuration having a raised peripheral bead (101) formed around the external faces of the block and an intermediate raised peripheral bead (102) disposed proximate the midpoint of the internal periphery of the glass block (100). It should also be mentioned at this juncture that at the present time, 4" glass building blocks (100) are fabricated in three standard sizes (e.g., 6×6 inch, 8×8 inch, and 12×12 inch).

Still referring to FIG. 1, it can be seen that the framework unit (11) comprises vertical (16) and horizontal (17) wall segments which are joined together by suitable fastening means to form a generally rectangular open framework member (18), wherein each of the vertical wall segments (18) are provided with a plurality of spaced apertures (19) whose purpose and function will be described presently.

Figure 2:
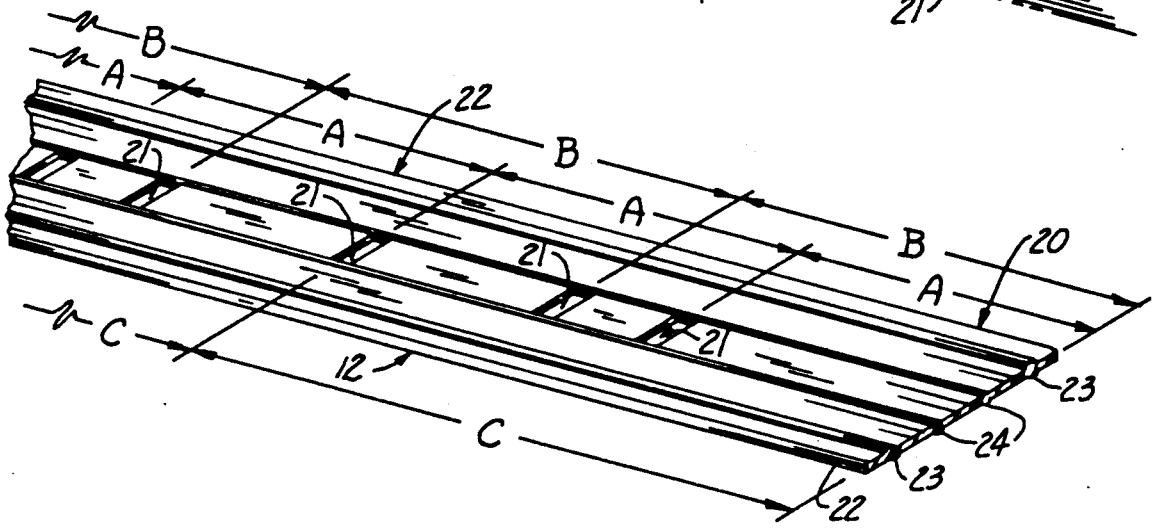
FIG. 2 is an enlarged detail view of the spacing of the apertures in the horizontal framework segments and the horizontal alignment unit.

As can be seen by reference to FIGS. 1 and 2, the horizontal alignment unit (12) comprises a plurality of enlarged, contoured horizontal slat members (20) each of the enlarged slat members (20) are provided with a plurality of apertures (21) whose spacing and dimensions are identical to the apertures (19) in the vertical wall strip (20).

In addition, as can best be seen by reference to FIG. 2, the different spacing A, B, and C between the apertures (21) coincides with the approximate size of the three 4" wide standard increments (6×6 inch, 8×8 inch, and 12×12 inch) of the currently available commercial glass building blocks (100).

Figure 5:
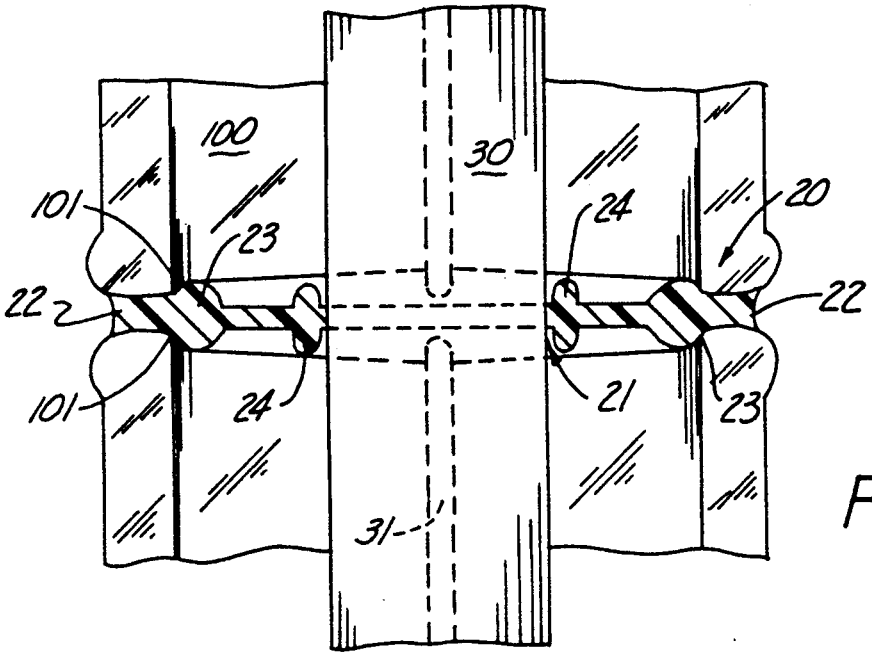
FIG. 5 is a side plan view of the structural components at the juncture of the glass blocks.

It should also be noted by reference to FIGS. 2 and 5 that the opposed sides (22) of the horizontal slat members (20) are contoured and colored to resemble a concave tooled joint and that a raised longitudinal bead (23) is disposed proximate to, but spaced from, the opposed sides (22) of the horizontal member (20). Furthermore, the horizontal slat members are also provided with a pair of intermediate longitudinal ribs (24) which are disposed on opposite sides of the plurality of spaced apertures (21).

Figure 3:
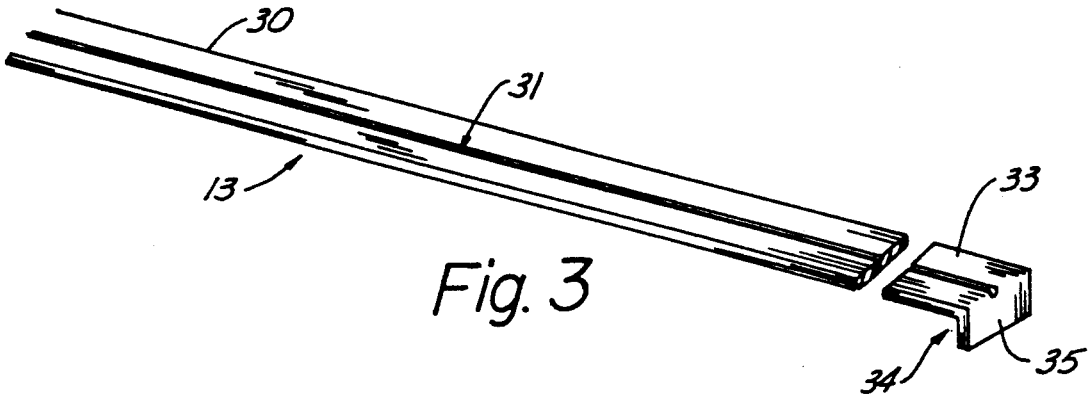
FIG. 3 is an isolated perspective view of one embodiment of the vertical alignment unit.
Figure 4:
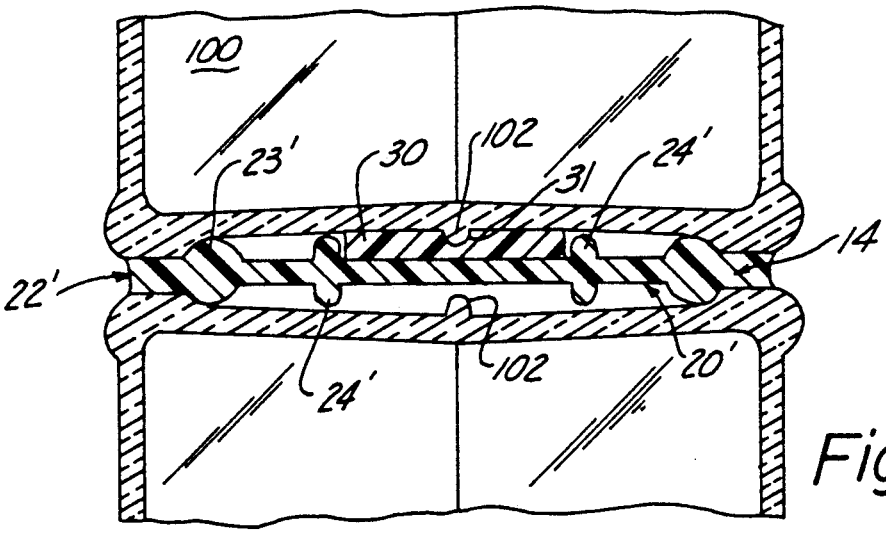
FIG. 4 is a top plan view of the structural components at the juncture of the glass blocks.

Turning now to FIGS. 1, 3, and 4, it can be seen that the vertical alignment unit (13) comprises a plurality of elongated relatively thin, flat, vertical slat members (30) having a longitudinal slot (31) formed in one of its faces (33) wherein one end (24) of the vertical slat (30) is provided with a foot segment (35) which is dimensioned to be received in a selected one of the spaced apertures (21) in the bottom horizontal slat member (20') to captively engage the elongated vertical slat member (30) in the upright position depicted in FIG. 1.

As can also be seen by reference to FIG. 1, the elongated vertical slats (30) are dimensioned to be received in the spaced apertures (21) in the horizontal slat (20) which coincide with the ends of the respective glass blocks (100).

As can be seen by reference to FIGS. 1, 4, and 5, the vertical brace units (14) have the same cross-sectional configuration as the horizontal slats (20), and in fact, the vertical brace units (14) comprise truncated segments (20') of the horizontal slats (20) wherein the height of the truncated segments (20') coincides with the height of the glass block (100) and the spacing between the intermediate ribs (24') on the truncated segments (20') is dimensioned to received the vertical alignment slats (30). In addition, the sides (22') of the truncated slats (20') are also contoured and colored to resemble a concave tooled joint.

Furthermore, as shown in FIG. 1, the horizontal jamb tie units (15) have the same cross-sectional configuration as the vertical slats (30) and in fact, the horizontal jamb tie units (15) comprise truncated segments (30') of the vertical slats (30) wherein the length of the truncated segments (30') coincides with the length of the glass block.

At this juncture, it should be apparent that all of the structural components of the assembly (10) which form the support matrix for the glass blocks (100) actually only comprise different lengths and orientations of the contoured slat (20) and the generally flat slat (30) which are arranged and assembled in accordance with the teachings of this invention.

In essence, the assembly unit (11) comprises a plurality of elongated lengths of the contoured slat (20) disposed in a generally rectangular configuration; wherein, the vertical spacer units (14) comprise truncated segments (20') of the contoured slat (20) and the horizontal alignment units (12) comprise a plurality of contoured slats (20). Likewise, the vertical alignment units (13) comprise elongated lengths of the generally thin flat slats (30) and the horizontal jamb tie units (15) comprise truncated segments (30') of the generally thin flat slats (30).

It should further be noted that as depicted in FIGS. 4 and 5, the raised beads (23, 23') are dimensioned to frictionally engage the internal surface of the raised peripheral bead (101) of the faces of the glass blocks (100).

Having thereby described the subject matter of the present invention, it should be apparent that many substitutions and variations of the invention are possible in light of the above teachings. It is therefore to be understood that the invention as taught and described herein is only to be limited to the extent of the breadth and scope of the appended claims.

I claim:

1. A glass block construction assembly for glass blocks having raised beads surrounding the external faces of the block and an intermediate raised bead surrounding the interior periphery of the block wherein the assembly comprises:

an outer assembly unit including vertical and horizontal wall segments which form an open framework member;

a horizontal alignment unit comprising a plurality of elongated contoured slat members provided with a plurality of spaced apertures; and opposed sides which are contoured and colored to resemble a concave tooled joint; wherein, the contoured members are further provided with a pair of upper and lower raised longitudinal ribs which are disposed on opposite sides of the said plurality of apertures;

a vertical alignment unit comprising: a plurality of elongated relatively thin and flat slat members provided with at least one elongated longitudinal slot wherein the flat slat members are dimensioned to be received in selected ones of said plurality of spaced apertures in the plurality of contoured slat members for forming an open matrix within the said assembly unit wherein the glass blocks are dimensioned to be received within the openings in the matrix; and, a plurality of vertical spacing units comprising truncated segments of said flat slat members wherein, said truncated segments of said flat members are dimensioned to be received between the raised longitudinal ribs on one side of the contoured slat members; and wherein, the longitudinal recess in the flat slat members is dimensioned to receive the said intermediate raised bead on the glass blocks.

2. The assembly as in claim 1 wherein the plurality of contoured slat members are still further provided with a pair of longitudinal raised beads which are disposed proximate to, but spaced from, the said opposed sides of the contoured slat members.

3. The assembly as in claim 2 further comprising:

horizontal jamb tie units comprising truncated segments of said elongated thin, flat slat members.

* * * * *